US005984604A

United States Patent [19]

McMahon

[11] Patent Number: 5,984,604

[45] Date of Patent: Nov. 16, 1999

[54] BASE FORMING OF CAN BODIES

[75] Inventor: Neil David McMahon, Oxford, United Kingdom

[73] Assignee: Carnaudemtal Box Inc., Wilmington, Del.

[21] Appl. No.: 08/930,639

[22] PCT Filed: Mar. 25, 1996

[86] PCT No.: PCT/GB96/00710

§ 371 Date: Dec. 4, 1997

§ 102(e) Date: Dec. 4, 1997

[87] PCT Pub. No.: WO96/31299

PCT Pub. Date: Oct. 10, 1996

[30] Foreign Application Priority Data

Apr. 7, 1995 [GB] United Kingdom ..... 9507204

[51] Int. Cl.[6] ..... B21D 22/30; B21D 45/08

[52] U.S. Cl. ..... 413/69; 72/348; 220/906

[58] Field of Search ..... 413/76, 69, 71; 72/344, 345, 348, 347, 349, 427; 220/608, 604, 906

[56] References Cited

U.S. PATENT DOCUMENTS

| | | | |
|---|---|---|---|
| 3,402,591 | 9/1968 | Maeder | 413/69 X |
| 3,771,344 | 11/1973 | Wright | 72/345 |
| 3,812,696 | 5/1974 | Kneusel et al. | 413/69 X |
| 4,065,951 | 1/1978 | Lyu | 413/69 X |
| 4,151,927 | 5/1979 | Cvacho et al. | 220/70 |
| 4,373,368 | 2/1983 | Heijting | 72/344 |
| 4,930,330 | 6/1990 | Weishalla | 72/348 |
| 5,056,350 | 10/1991 | Moen et al. | 72/345 |

FOREIGN PATENT DOCUMENTS

| | | |
|---|---|---|
| 0045116 | 2/1982 | European Pat. Off. . |
| 0118926 | 9/1984 | European Pat. Off. . |

*Primary Examiner*—James F. Coan

*Attorney, Agent, or Firm*—Diller, Ramik & Wight, PC

[57] ABSTRACT

Can bodies are formed typically by drawing and wall-ironing a cup, introducing fluid between punch and dies as the cup exits the dies and then forming the desired base profile. The can bodies formed in the present invention are able to be produced from thin hard material such as double reduced steel and/or have stronger base profiles in terms of tighter radii and deeper countersinks than was hitherto possible without risk of splitting.

6 Claims, 3 Drawing Sheets

BASE FORMING OF CAN BODIES

This invention relates to a method of drawing hollow articles from a blank. In particular, it relates to a method of drawing a cup-shaped blank into a drawn and wall-ironed (DWI) one-piece can body.

In known methods of drawing cans, the blank is held on a punch and carried through a succession of dies for drawing the shallow cup and ultimately strikes a bottom former to produce the desired base profile. For beverage cans, this base profile is typically a dome, whereas for food cans the base profile typically has a plurality of concentric annular panels surrounding a central panel. Alternatively, the base profile may be formed in a separate process which combines pressing the inner annular beads and then roll forming a deeper outer "anti-peaking" bead.

The material used for can manufacture is costly and so efforts have been made over recent years to reduce the thickness of the material required so as to reduce material costs accordingly. However, limitations in the thickness reduction are imposed by the forming process and by the particular base profile which is required in order to cope with thermal processing and pasteurisation and with conditions imposed by the product itself, such as carbonated beverages.

Food cans are often formed from a ferrous material, for example single reduced (SR) or double reduced (DR) steel. The steel is typically in the form of tinplate such as T57 tinplate. This tinplate has a yield strength of 200 to 300 $Nmm^{-2}$ and UTS of 330 to 410 $Nmm^{-2}$. Minimum elongation to fracture is 23% and proof/UTS is 80 to 90%. Usually the tinplate finish used for food cans is matt although flow brightened tinplate is used for some applications such as partially lacquered cans. The tin coating is usually selected according to the product for which the can is to be used, for example T57 tinplate cans used for human food have a tin coating of 2.8/2.8 $gm^{-2}$.

The profile used for the base of one-piece can bodies formed in a single process exhibits thinning around the tight bead radii due to the tensile forces arising during base formation. Base forming loads are particularly high where the can is wall-ironed. Thinning is a particular problem at the innermost bead and if the material is too thin will lead to splitting of the base at this point. Consequently, the minimum thickness which it is possible to use for formation of a one-piece 73 mm diameter DWI can body in a single process from T57 tinplate is 0.275 mm SR, or 0.270 mm SR for a 65 mm DWI food can. Conventional bases may be formed from 0.270 mm SR material without splitting but these are not strong enough to withstand some processing pressures.

SUMMARY OF THE INVENTION

According to the present invention there is provided a can body formed by the steps of:

passing a cup on a punch through a series of dies to increase the height of the cup side wall;

introducing fluid between the punch and the drawn cup after it exits the dies; and pressing the drawn cup against a base forming tool to form the desired base profile;

in which the can body has a side wall integral with the end wall, the end wall including at least one annular bead surrounding a central panel, the or one of the bead(s) having an internal radius of between 0.8 mm and 1.4 mm.

Typically the internal radius may be 1.4 mm for a 73 mm diameter can body but may be reduced to as low as 0.8 mm for the same can body by the introduction of fluid in accordance with the invention. These radii are much tighter than has been found possible using conventional base forming methods and the resultant base profile is much stronger. This radius may usually be what is known as the "countersink radius". The radii are not related to specific can diameters but typical can diameters for which these profiles would be used are 65 and 73 mm.

The can body may be formed from tinplate having a UTS value of up to 650 $Nmm^{-2}$, preferably 500 $Nmm^{-2}$ or less. The tinplate may be double reduced steel and may have a thickness of at least 0.15 mm.

This can body is preferably drawn and wall ironed as it passes through the series of dies.

According to a second aspect of the present invention, there is provided a can body formed by the steps of:

passing a cup on a punch through a series of dies to increase the height of the cup side wall;

introducing fluid between the punch and the drawn cup after it exits the dies; and pressing the drawn cup against a base forming tool to form the desired base profile;

in which the can body has a side wall integral with the end wall, the end wall including a peripheral channel portion having a depth of between 4% and 8% of the can body diameter.

Typically the depth of the peripheral channel portion may be 4.7 mm for a 73 mm diameter can body. This channel portion is much deeper than has been found possible using conventional base forming methods and the resultant base profile is much stronger.

Preferably, an inner wall of the channel portion supports a central panel and at least one annular bead join the channel portion to the central panel, the or one of the bead(s) having a radius of between 0.5 mm and 2 mm. Typically, the bead radius may be 0.76 mm.

The can body may be formed from tinplate having a UTS value of up to 650 $Nmm^{-2}$, preferably 500 $Nmm^{-2}$ or less. The tinplate may be double reduced steel and may have a thickness of at least 0.15 mm. Thicker gauge steel is, however, preferably single reduced.

The can body according to this aspect of the invention is preferably drawn and wall-ironed but having a base profile which has formerly only been developed for drawn and redrawn (DRD) cans. This base profile is considerably stronger than that of the first embodiment and is better able to withstand the internal pressures which arise during thermal processing without inversion of the base.

According to yet another aspect of the present invention, there is provided a can body formed by the steps of:

passing a cup on a punch through a series of dies to increase the height of the cup side wall; introducing fluid between the punch and the drawn cup after it exits the dies; and pressing the drawn cup against a base forming tool to form the desired base profile;

in which the can body has a side wall integral with the end wall and is formed from tinplate having a UTS value of up to 650 $Nmm^{-2}$ In a preferred embodiment, the tinplate has a UTS of 500 $Nmm^{-2}$ or less. The tinplate may be double reduced steel and may have a thickness of at least 0.15 mm.

The can body of this embodiment of the present invention may be formed with a base profile according to either of the other two embodiments.

In each of the embodiments of the invention, the fluid is preferably introduced at least 20° before bottom dead centre (BDC) of the punch otherwise forming loads are not reduced.

For steel food cans, it thus can be seen that the basic advantage of lightweighting is achieved by the present invention either by using higher strength materials such as DR, or by using stronger base profiles, similar to those at present used for DRD cans, or by a combination of stronger material and base profile.

As a direct result of this invention, it has been found to be possible to produce a can from thin hard material such as DR steel and/or to form a base having a stronger profile than is usually possible in a single operation whilst the can body is still carried by the punch. There is thus a further advantage of the present invention for steel food cans, namely the production of a stronger base profile in a single base forming operation.

It should be appreciated that the present invention is not limited to can bodies of steel in the form of tinplate, or having base profiles which are suitable for food products only. For example, can bodies with domed base profiles are typically used for beverage products.

In a further embodiment, it is believed that hard steels of up to 500 $Nmm^{-2}$ yield, 520 $Nmm^{-2}$ UTS may be used for domed base profiles for beverage cans, in which the can body is produced from 0.18 mm DR tinplate in accordance with the present invention. This has not previously been possible without splitting the base stand bead.

Increased strength for such steel beverage cans is obtained only from the strength of the material. It is not possible to produce stronger beverage base profiles due to problems which arise during lacquer spraying.

Other embodiments of beverage can bodies made of aluminium are also within the scope of this invention. Typically, the forming process of this invention enables gauges of 0.25 mm aluminium to be used, whereas previously the thinnest gauge for aluminium beverage cans has been 0.28 mm. Significant lightweighting advantage is obtained by a combination of the use of stronger aluminium alloys having about 360 UTS and by stronger base profiles. These stronger base profiles are obtainable by producing smaller radii in the bodymaker than at present, typically between 1 mm and 1.5 mm, and by subsequently reforming to produce stronger base profiles.

It has surprisingly been found that the method by which the can bodies of the present invention are manufactured, in which fluid is forced between the punch and the can wall during the base forming operation, considerably reduces the tensile forces in the can base during forming. It is believed that this is as a result of friction between the can and punch being reduced as the can is "pulled down" during the formation of the base.

Preferably, the fluid which is introduced comprises coolant fluid or other liquid and is advantageously introduced via ducts which pass along the longitudinal axis of the punch and exit the punch around the punch perimeter, at the top of the cup side wall. The main advantage of having ducts in the top wall is that it is much easier in this way to select a tool match to avoid ironing material from the can wall into the holes. Furthermore, this avoids fatigue failure which would arise if the fluid were introduced at the angle between the top wall of the transition between thin and thick material on a wall ironed side wall.

The use of a coolant fluid which is introduced at the transitional point described above has been proposed in EP-A-0045116 to aid in stripping the can body from the punch after forming. However, that application does not suggest that the introduction of coolant fluid between the punch and the can body enables the formation of a can body from thinner material and/or having a stronger base profile.

Although it is possible to use a gas or air as the fluid, this is not a preferred choice since the gas would need to be maintained at a constant pressure which is difficult to achieve in a controlled manner due to the compressibility of the gas.

In addition, it is preferred for convenience that the fluid is introduced at the same time as air is passed through the punch to the base in order to aid in stripping of the can from the punch.

Generally, this may be at 60° before bottom dead centre (BDC). It should be appreciated, however, that this timing is for convenience only and that fluid may be introduced at any time, or indeed permanently, after the cup has left the drawing/ironing dies. It is important that the fluid is not introduced during ironing since the reduction of friction between the punch and the cup at this stage leads to an imbalance in forces on the cup side wall, resulting in tearing. It is also important to keep the cup feed area free from coolant fluid.

The fluid may usually be introduced at a pressure of 200 psi, although pressures of between 150 and 2000 psi are also acceptable.

Preferred embodiments of the present invention will now be described with reference to the drawings, in which:

DESCRIPTION OF THE PREFERRED EMBODIMENTS

Figure 1:
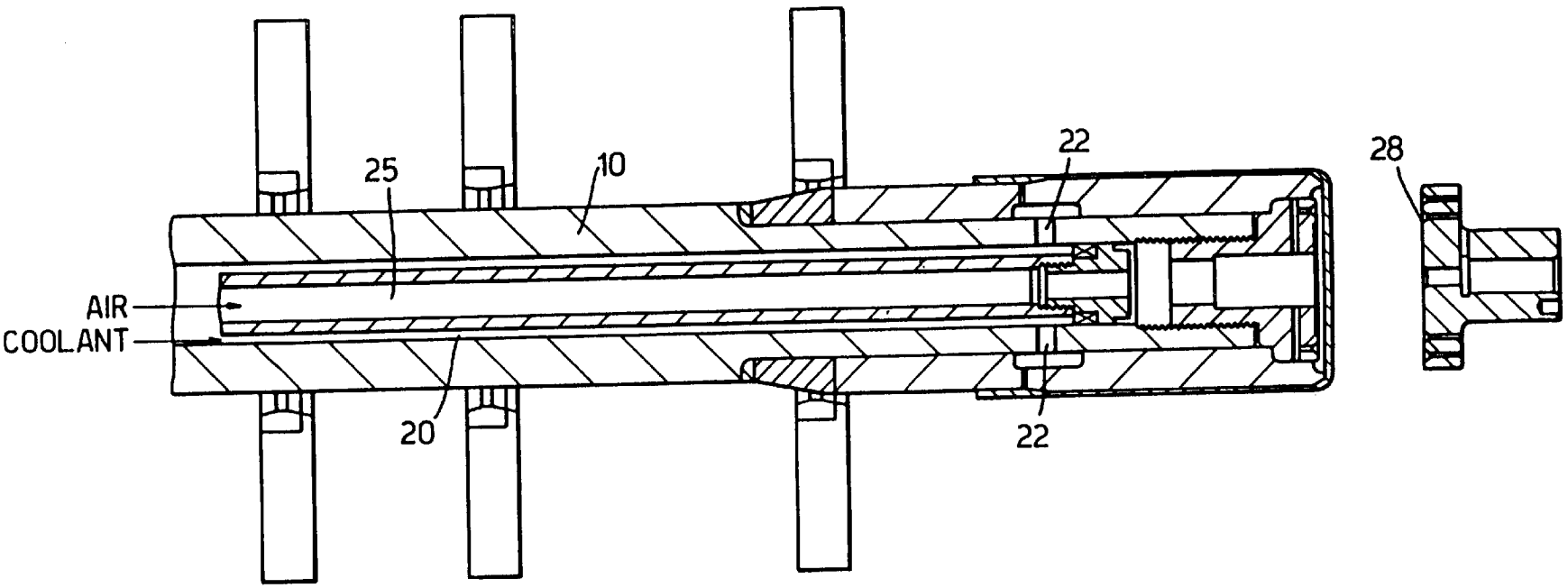
FIG. 1 is a side section of part of an apparatus for forming a drawn and wall ironed can body.

A mechanical press, part of which is shown in FIG. 1, typically comprises a frame which supports a tool pack comprising a redrawing die, two ironing rings or dies and a stripper, through which a punch 10 can pass. A bottom forming pad 28 is axially aligned with the toolpack.

The punch 10 has a longitudinal fluid duct 20 which connects with the perimeter of the punch in the broad part of the punch via a series of radially extending channels 22. A second longitudinal duct 25 passes through the length of the punch and exits at the front face of the punch.

Figure 2:
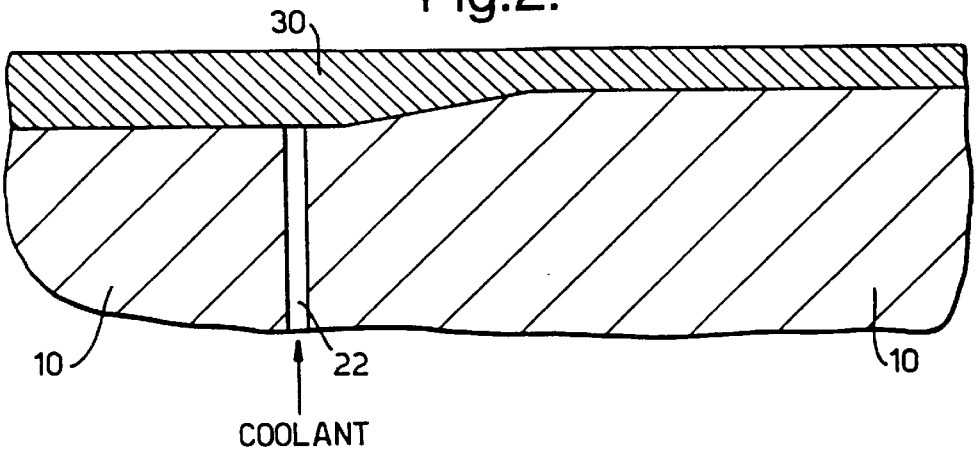
FIG. 2 is a side section of the top wall profile of a high pressure stripping punch of the apparatus of FIG. 1.

In use, cups are fed in turn from a feeder chute to the punch and each shallow drawn cup is pressed against the surface of the redrawing die in the tool support. Subsequently, the redrawn cup is pushed through the ironing rings to make the can body 30 having a side wall thinner than its bottom wall. After exiting the dies/rings, fluid is introduced via the radial channels 22 at a point about 20° before BDC of the punch, as shown in FIG. 2, simultaneously with the provision of pressurised air to the punch face via the second duct 25. The cup then strikes the bottom forming pad and the desired base profile is formed in a single operation. On the return stroke of the punch the can body 30 is stripped from the punch by the stripper.

COMPARATIVE EXAMPLE 1

Figure 3:
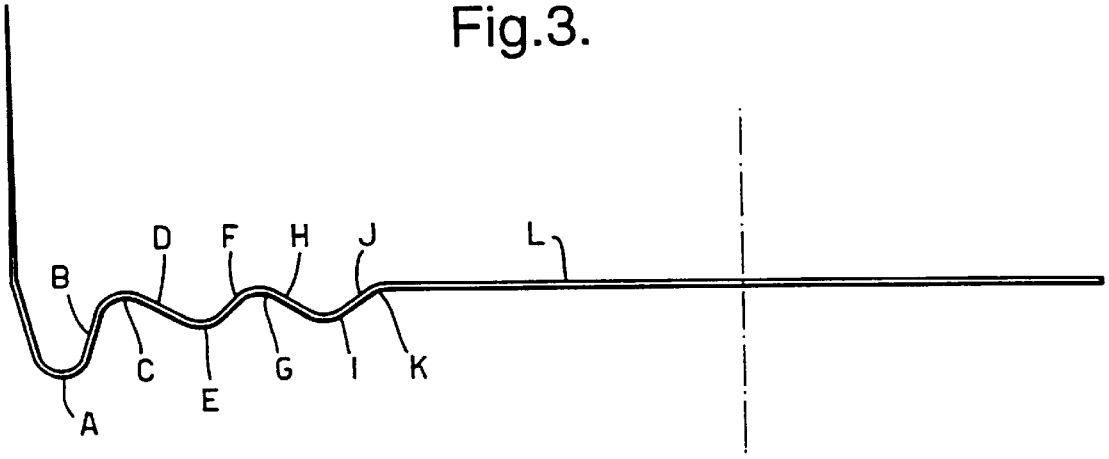
FIG. 3 is a partial side section of a first can body base profile.

A 73 mm diameter DWI can body of 0.275 mm SR T57 tinplate (see specification above) having a conventional DWI base profile as shown in FIG. 3 and formed in the conventional manner, ie without the introduction of fluid between the punch and the cup, was cut open so as to measure the thickness of the beaded base at different points along the base radius. The thicknesses at different points along the radius are shown in table 1. A bulging test was carried out on an equivalent DWI can body and yielded a bulge pressure of 3.103 bar (50 psi).

TABLE 1

All dimensions are in mm:

| | | | | | |
|---|---|---|---|---|---|
| A | 0.270 | E | 0.261 | I | 0.258 |
| B | 0.264 | F | 0.270 | J | 0.267 |
| C | 0.270 | G | 0.258 | K | 0.240 |
| D | 0.270 | H | 0.270 | L | 0.264 |

EXAMPLE 1

A DWI can body of 0.22 mm DR tinplate having a UTS of 460 $Nmm^{-2}$ was manufactured in accordance with the method of the present invention, introducing coolant fluid between the punch and the cup at 60° before TDC of the punch, and the same tests were carried out as in comparative example 1. The base profile was that of FIG. 3, the profile conventionally used for DWI cans. The results of these tests are shown in table 2. The equivalent bulge data was 2.689 bar (39 psi).

TABLE 2

All dimensions are in mm:

| | | | | | |
|---|---|---|---|---|---|
| A | 0.215 | E | 0.215 | I | 0.210 |
| B | 0.215 | F | 0.218 | J | 0.215 |
| C | 0.218 | G | 0.213 | K | 0.200 |
| D | 0.218 | H | 0.217 | L | 0.218 |

COMPARATIVE EXAMPLE 2

Figure 4:
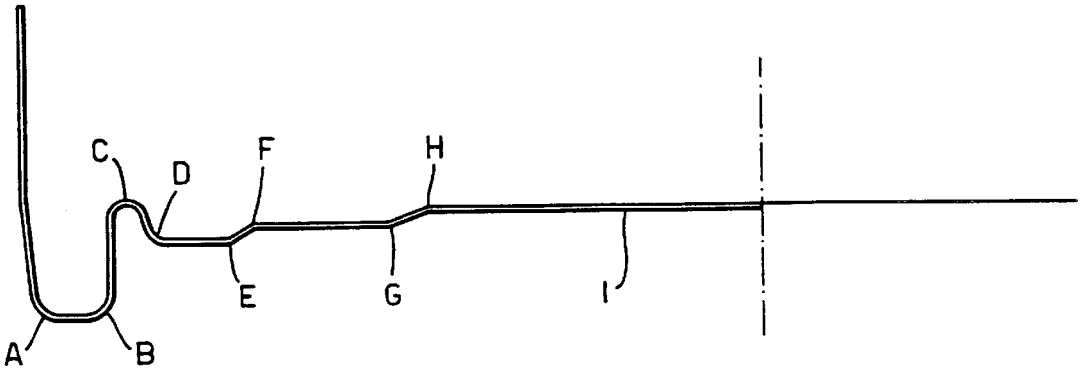
FIG. 4 is a partial side section of a second can body base profile.

A 73 mm diameter DRD can body of 0.18 mm DR steel in the form of tinplate having a UTS of 650 $Nmm^{-2}$ and having the base profile shown in FIG. 4 was formed in conventional manner by a single press operation and cut open so as to measure the thickness of the base at various points along the radius. An equivalent can body yielded peak data of 2.793 bar (40.5 psi). These results are presented in table 3.

TABLE 3

All dimensions are in mm:

| | | | | | |
|---|---|---|---|---|---|
| A | 0.171 | D | 0.163 | G | 0.170 |
| B | 0.171 | E | 0.176 | H | 0.171 |
| C | 0.171 | F | 0.171 | I | 0.176 |

EXAMPLE 2

A DWI can body of 0.22 mm DR tinplate with a UTS of 460 $Nmm^{-2}$ having a base profile similar to the DRD can of comparative example 2 and FIG. 4 but having radii at E, F, G and H of 1 mm and a tapered outer wall, was formed in a single press operation using a bottom former having the appropriate profile.

This can body was also cut open, thickness data being given in table 4. Finally, an equivalent can body yielded peak data of 3.52 bar (51 psi).

TABLE 4

All dimensions are in mm:

| | | | | | |
|---|---|---|---|---|---|
| A | 0.209 | D | 0.199 | G | 0.206 |
| B | 0.209 | E | 0.215 | H | 0.208 |
| C | 0.207 | F | 0.209 | I | 0.215 |

EXAMPLE 3

Figure 5:
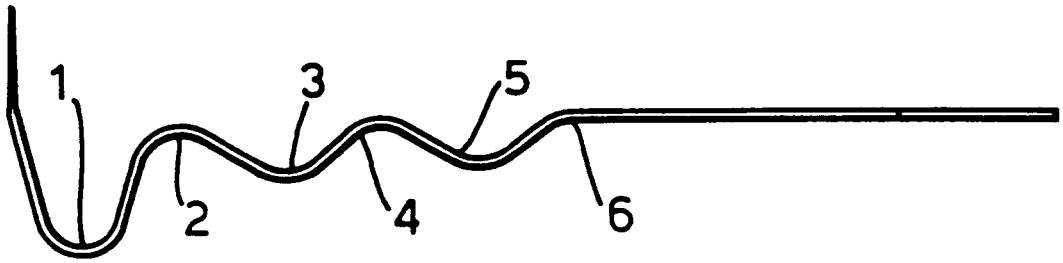

DWI cans with a standard DWI base profile corresponding to that shown in FIG. 5 were produced from 0.12 mm SR T57 tinplate. This gauge contrasts with the lowest gauge for SR material used to date in production which is 0.275 mm (although it has been believed possible to use tinplate of 0.27 mm gauge with conventional processes). The tin coating was 2.8/2.8 $gm^{-2}$ and matt finish. The profile of FIG. 5 is that of the bottom former tooling, the profile of a base formed using this tooling having a complementary profile. The radii for the profile of FIG. 5 are given in table 5.

Where cans were formed in the conventional manner, ie no fluid was introduced between the punch and the drawn cup, there was a high incidence of base splitting. The bases of the remaining unsplit cans were blown out by the air strip system. Turning the air strip pressure down to prevent the bases from being blown out resulted in implosion of the cans during stripping.

Where fluid was introduced to produce cans with the profile of FIG. 5 from the same tinplate, there was no incidence of splitting, blow out or implosion.

TABLE 5

All dimensions are shown in mm

| Position | Radius |
|---|---|
| 1 | 1.21 |
| 2 to 6 | 1.4 |

EXAMPLE 4

DWI cans with the standard DWI profile of FIG. 5 were produced from 0.22 mm DR tinplate having a tensile strength of 350 $Nmm^{-2}$, in contrast with tinplate used conventionally which has a tensile strength of 270 $Nmm^{-2}$. The yield strength was 423 $Nmm^{-2}$ and the UTS was 450 $Nmm^{-2}$. Elongation to fracture was 15.8%, proof/UTS 94.4% and the tin coating was 2.0/2.0.

The bases of all cans formed without the introduction of fluid split. This was not surprising since it is well known that tinplate having reduced gauge and increased tensile strength is more susceptible to splitting when formed. In spite of this disincentive, cans were formed from the above tinplate using the hydraulic assist of the method of the present invention with the surprising result that none of the cans split.

EXAMPLE 5

Figure 6:
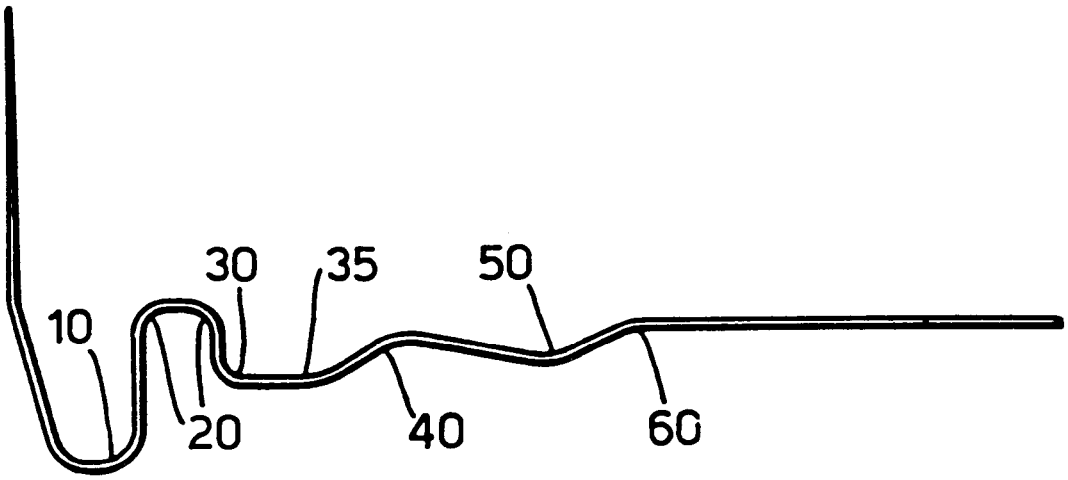

Cans with a high performance conventionally DRD style of base profile as shown in FIG. 6 were produced from 0.285 mm T57 tinplate. The peaking pressure for this profile was 76 psi, in contrast with a peaking pressure of 56 psi achieved for the same material having the base profile of FIG. 5.

The radii for the profile of FIG. 6 are given in table 6.

TABLE 6

All dimensions are shown in mm

| Position | Radius |
|---|---|
| 10 | 1.13 |
| 20 | 0.8 |
| 30 | 0.8 |
| 35 | 3.0 |
| 40 | 2.5 |
| 50 | 1.82 |
| 60 | 1.0 |

Although a preferred embodiment of the invention has been specifically illustrated and described herein, it is to be understood that minor variations may be made in the apparatus without departing from the spirit and scope of the invention, as defined the appended claims.

What is claimed is:

1. A can body formed by the steps of:

passing a cup on a punch through a series of dies to increase the height of the cup and form a drawn can body having a side wall integral with an end wall;

introducing fluid between the punch and the drawn can body side wall after the drawn can body exits the dies; and pressing the drawn can body against a base forming tool to form the end wall into a desired base profile including at least one annular bead surrounding a central panel, and the at least one annular bead having an internal radius of between 0.8 mm and 1.4 mm.

2. A can body according to claim 1, in which the can body is formed from double reduced steel having a thickness of at least 0.15 mm.

3. A can body according to claim 1, in which the fluid is introduced at least 20° before bottom dead centre of the punch.

4. A can body formed by the steps of:

passing a cup on a punch through a series of dies to increase the height of the cup and form a drawn can body having a side wall integral with an end wall;

introducing fluid between the punch and the drawn can body side wall after the drawn can body exits the dies; and pressing the drawn can body against a base forming tool to form the end wall into a desired base profile and the can body is formed from tinplate having a UTS of up to 65 Nmm.

5. A can body formed by the steps of:

passing a cup on a punch through a series of dies to increase the height of the cup and form a drawn can body having a side wall integral with an end wall;

introducing fluid between the punch and drawn can body side wall after the drawn can body exits the dies; and pressing the drawn can body against a base forming tool to form the end wall into a desired base profile including a peripheral channel portion having a depth of between 4% and 8% of the can body diameter.

6. A can body according to claim 5, in which an inner wall of the channel portion supports a central panel and at least one annular bead joins the channel portion to the central panel, and the at least one bead having a radius of between 0.5 mm and 2 mm.

* * * * *